United States Patent [19]

Ward

[11] 4,120,278

[45] Oct. 17, 1978

[54] AUTOMATIC SHUT-DOWN CONTROL SYSTEM FOR TRUCK DIESEL ENGINES EQUIPPED WITH EXHAUST-DRIVEN SUPERCHARGERS

[76] Inventor: Gaylan J. Ward, 2626 Chico Ave., S. El Monte, Calif. 91733

[21] Appl. No.: 724,268

[22] Filed: Sep. 17, 1976

[51] Int. Cl.[2] ..... F02B 77/00

[52] U.S. Cl. ..... 123/198 D; 123/148 S

[58] Field of Search ..... 123/198 DB, 198 DC, 123/198 D, 102, 148 S

[56] References Cited

U.S. PATENT DOCUMENTS

| | | | |
|---|---|---|---|
| 2,861,558 | 11/1958 | McClain | 123/198 DC X |
| 3,241,539 | 3/1966 | Kuehn | 123/198 DC |
| 3,680,539 | 8/1972 | Savage et al. | 123/198 DB |

*Primary Examiner*—Charles J. Myhre
*Assistant Examiner*—Ira S. Lazarus
*Attorney, Agent, or Firm*—Boniard I. Brown

[57] ABSTRACT

An automatic control system for turbo-charged truck Diesel engines incorporates one or more electronic or electromechanical timers for the operation of the fuel line solenoid valve and of the fast-idle solenoid, where fitted. The timers are automatically started upon the opening of the ignition switch, or are controlled from an independent control switch, in such a manner that upon the receipt of a 'start' signal, the engine continues to operate for predetermined periods in the 'fast idle' and 'idle' speed regimes and is then shut down. These periods of operation at slow speeds permit the exhaust-driven turbocharger to attain equilibrium temperatures before engine shut-down.

4 Claims, 6 Drawing Figures

AUTOMATIC SHUT-DOWN CONTROL SYSTEM FOR TRUCK DIESEL ENGINES EQUIPPED WITH EXHAUST-DRIVEN SUPERCHARGERS

BACKGROUND OF THE INVENTION

The invention relates to automatic control systems for turbocharged Diesel engines in trucks. It relates, more particularly, to such control systems employed to provide for an automatic shutdown sequence in such engines.

In recent years the provision of Diesel engines for commercial trucks has increasingly been accompanied by the use of exhaust-driven turbosuperchargers for improvement of engine specific outputs and for a reduction of specific fuel consumption. The use of such accessory superchargers is relatively simple and, in comparison to the benefits obtained, relatively inexpensive.

One major dfference in the operation of Diesel truck engines has been due to the introduction of such superchargers, this is the requirement for specific shutdown sequences. The turbosupercharger is commonly a very sensitive device, operating at high temperatures yet possessing very little thermal mass of its own. Consequently, upon the cessation of engine operation very rapid cooling of the turbine disk is likely, and may result in damage to that component due to thermal stresses.

The several manufacturers of engines and turbosuperchargers indicate the need for engine operation at idle speed, or at some speed slightly above normal idle, for specified periods of time, to allow the turbine disk to attain a temperature level sufficiently low, so that shutdown thereafter will not induce damaging thermal stresses. In practice, however, the proper observance of such shutdown procedures is left to the skill and conscientiousness of the truckdriver, who may not be properly instructed in the appropriate procedures, or who may be unaware of the specific requirements of the rig he is entrusted with.

In practice, except for the relatively small number of drivers who conform to the required shutdown procedures, two alternatives emerge: either the engine is shut down immediately after the driver finishes his run, with the attendant danger of permanent damage to the supercharger, or, alternately, he remembers to leave the engine idling, but does so for an uncontrolled length of time. This latter alternative is also quite undesirable, since the lubricating system of the supercharger is generally not designed for extended periods of idle operation; in particular, the seals therein may become distorted and leak, thus resulting in eventual breakdown of the bearings.

It is, therefore, the primary object of the invention to provide the means, in the form of an automatic control system, whereby the proper operation of the engine during the shutdown procedure is removed from the control of the driver and the required periods of operation at the specified engine speeds is assured.

It is an additional object of the invention to provide such automatic control systems which are readily adapted to the several variations in engines and superchargers found in the industry, and which may be readily accomodated to the various control systems and electrical systems—12 and 24 volt operation, positive and negative grounds—met with.

It is a further object of the invention to provide such automatic control systems which are simple in construction, readily installed in commercial vehicles fitted with turbosupercharged Diesel engines, and trouble-free in operation.

SUMMARY OF THE INVENTION

The invention attains its objects, and other objects and advantages which shall become apparent from the detailed description of the preferred embodiment thereof, by providing an electronic, or electromechanical, timer in a circuit which is activated by the action of the removal of the ignition key from the 'run' position. The timer is arranged in such a manner that an output signal is provided for a predetermined time to bias a power transistor which then powers the necessary circuits required for the continued operation of the engine.

Because of the differing characteristics of commercially available engines in the trucking field, alternate embodiments are provided for systems wherein the main engine fuel valve solenoid is powered during engine operation or, contrariwise, is powered to shut off the flow of fuel.

Similarly, provision may be made, by changing a plug-in circuit, for use with chasses employing positive or negative-ground electrical systems.

At the conclusion of the pre-determined period after the removal of the ignition key, the timer removes the gate signal from the power transistor and, thereby, ensures either the cessation of engine operation, or the transfer of control to a subsidiary timing circuit, analogous to the primary circuit, which keeps the engine operating in a different speed regime, should such an operation be called for by the manufacturer's instructions.

The detailed construction and operation of the preferred embodiment of the invention will be described below with reference to the accompanying drawing, wherein:

FIG. 1 is a perspective view of a typical highway tractor and semi-trailer combination, powered by a Diesel engine equipped with a turbine-driven supercharger and provided with a shutdown timing control system according to the invention;

FIG. 2*a* is a schematic diagram of the electrical harness interconnecting the engine controls with the timing control of the invention, adapted for chasses with negative ground electrical circuitry;

FIG. 1*b* is a schematic diagram of the primary timing control circuit of the device of the invention;

FIG. 2*c* is a schematic diagram of the interconnecting harness, adapted for a chassis with a positive ground electrical circuit;

FIG. 3 is a diagrammatic control schematic for a shutdown control system for an engine wherein the fuel valve solenoid has to be powered for a specific period to secure engine shutdown; and FIG. 4 is a diagrammatic control schematic for a shutdown control system for an engine wherein two specific time periods of engine operation at different speeds are required prior to shutdown.

DESCRIPTION OF THE PREFERRED EMBODIMENT

Figure 1:
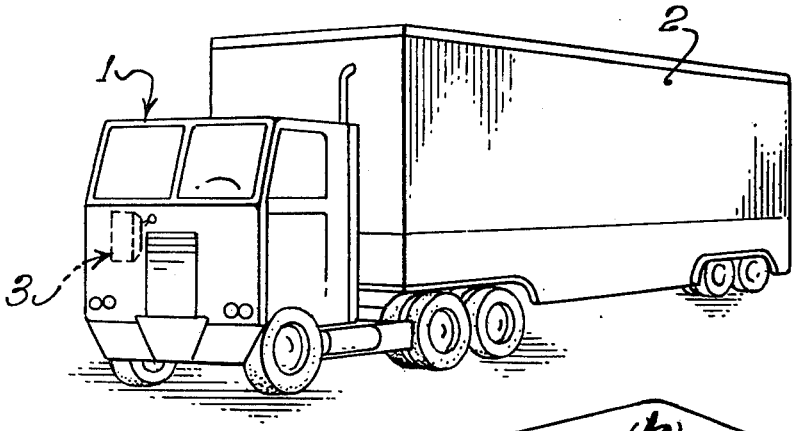

FIG. 1 is a perspective view of a highway transporter combination, including a tractor 1 and a trailer 2. The tractor 1 is powered by a Diesel engine, equipped with an exhaust-driven turbo-supercharger, and is provided with a shutdown timer control 3, allowing the driver to initiate engine shutdown by the simple removal of the ignition key. The control 3 ensures that the engine is kept operating under the conditions, and for the time intervals, specified for the particular engine/supercharger combination without further supervision by the driver.

As an example, the appropriate operating instructions may specify that the engine operate for 3 minutes each at a fast idle and at a slow idle speed in the neighborhood of 1000 RPM and 600 RPM, respectively. The timer control 3 will then ensure that the engine is run at 1000 RPM—by operating an appropriate governor control position or a 'fast-idle solenoid' on the throttle shaft, for 5 minutes, and then operate at a slow idle for another half minute, halting the supply of fuel to the engine at the end of the 6-minute period.

Since the operation of the engine in the idle regimes creates a relatively cool exhaust flow, the hot end of the turbo-supercharger is brought down from its full-load temperature, which may approximate 2000° F, to a temperature at which a sudden cessation of gas flow therethrough will not result in unacceptable thermal stresses. At the same time, the control 3 ensures that the driver does not operate the engine for an excessively long period at idle conditions, in an attempt to comply with the shutdown requirements manually, with a possibly deleterious influence on the turbocharger lubricating system.

Figure 2:
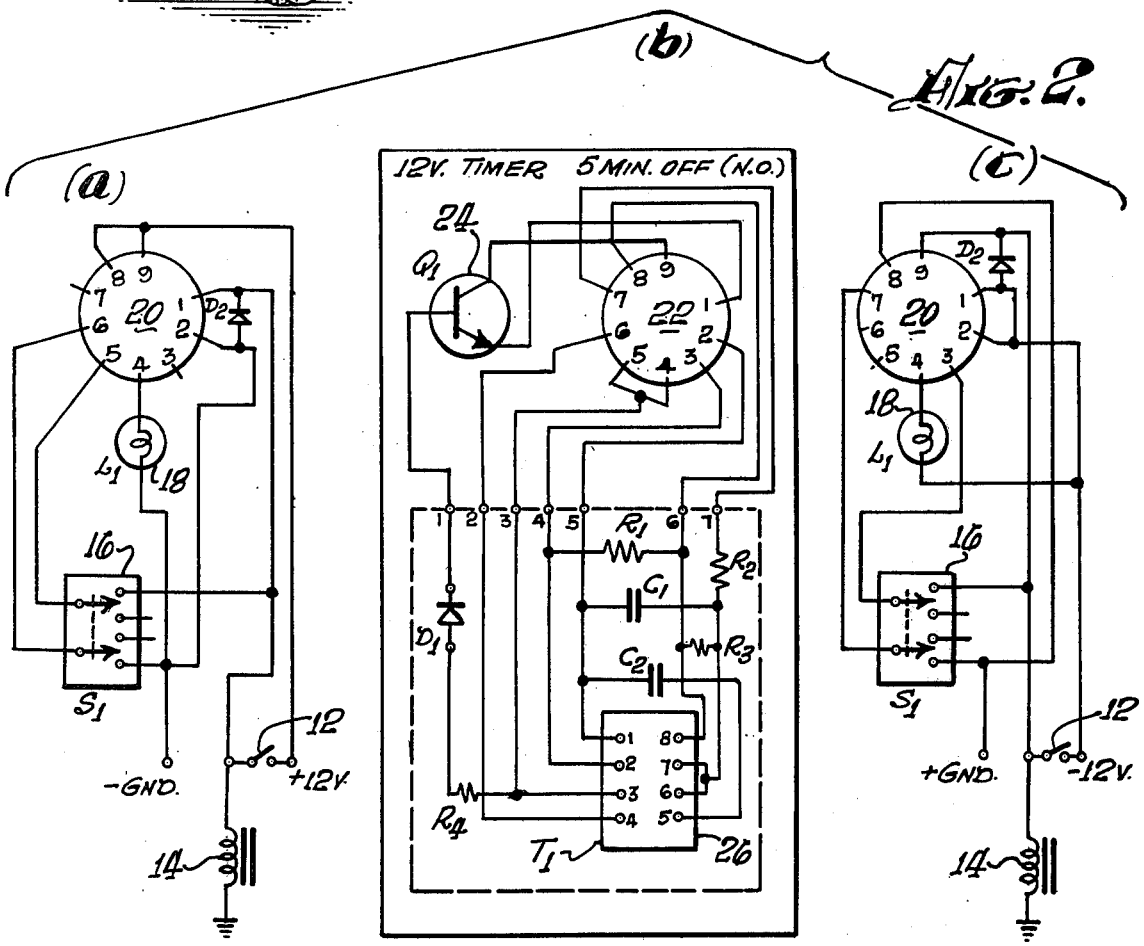

Turning to FIG. 2, we see schematic diagrams of the main elements of basic embodiments of the timer control 3, including a plug 20 and a socket 22 which mate to interconnect the harness portion of the timer control with the basic timing circuit. The former is shown, in versions adapted to positive and negative ground vehicles, respectively, in FIGS. *2a* and *2c*, while the latter is illustrated in FIG. *2b*. The plug 20 receives several electrical leads connected to the basic truck and engine control—such as ignition switch 12 and fuel valve solenoid 14—and to those components of the timer control 3 which are to be mounted on the driver's control panel—such as function light 18 and operating switch 16. The essential components of the alternate harness circuits shown in FIGS. *2a* and *2c*, respectively, are identical and the description below is applicable to both.

The specific circuitry shown in FIGS. *2a* and *2c* is typical of such engine installations—those employing Cummins engines, for example—in which the fuel solenoid valve is powered during engine operation and de-energized for engine shutdown. Consequently the operating coil 14 of the solenoid valve is connected directly to the 'on' terminal of the ignition switch 12. Since in this type of installation the removal of the key would automatically cause the cessation of fuel flow, a manual switch 16 is introduced into the system to permit the actuation of the timer control 3 by a momentary actuation of the switch 16 so as to interconnect pin 5 of the plug 20—in the circuit of FIG. *2a*—with the 'on' terminal of the ignition switch. This starts the integral time-lapse circuit, and permits the removal of the key without de-energizing the solenoid coil 14. A reverse operation of the switch 16, a two-pole, double-throw momentary unit, deenergizes the time-lapse circuit, should this be desirable. Function light 18 glows during the time period, indicating the proper functioning of the timer control.

It is to be understood that the manual switch 16 may be replaced with automatic sensing circuitry—based on a charged capacitor, for example—which would permit the appropriate timer start signal to be derived from the opening of the ignition switch 12, and which would have the requisite time delay response to restore the fuel valve coil 14 to the energized condition before the engine would stall due to fuel starvation.

The main components of the timer control 3 are mounted on a separate panel or circuit board and contain, apart from the socket 22 mating with the plug 20, an npn power transistor 24 and an integrated-circuit time-lapse circuit 26. While many different IC timers are available and suited to this application it has been found advantageous to employ a device marketed by the Radio Shack organization under the designation RS555 for the time-lapse circuit 26. Timing circuit chips of this type, and analogues thereof, have good stability, repeatability, may be adjusted over a wide time range, and are compatible with the temperature and vibrational environment prevailing in commercial vehicles.

The power transistor 24 receives its gate signal from the time-lapse circuit 26 and permits the flow of sufficient current, in the range around 6 amperes, to power the fuel valve solenoid 14 during the 'on' period of the timer. Diodes $D_1$ and $D_2$ are provided in the circuit to shield the IC chip 26 from current surges arising external to the system and, in particular, to prevent the inadvertent initiation of timer functioning due to leakage currents. A resistor $R_1$ is provided for the stabilization of the circuit, while capacitor $C_1$ and resistor $R_3$ represent the timing components through which the operating period of the time-lapse component 26 is fixed. $R_2$ is an impedance whose inclusion in the circuits aids in securing a clean cut-off of the power output, $R_4$ is a bias resistor for the power transistor 24, and $C_2$ is an external capacitor utilized in the internal voltage control of the IC chip.

While the specific values and arrangement may vary with the requisite time intervals and the exact nature of the solid-state components employed, the following ratings are applicable to the specific circuit of FIG. 2 utilizing the RS555 timer chip:

$R_1$—$10\times10^3$ ohms
$R_2$—$2\times10^3$ ohms
$R_3$—$2.2\times10^6$ ohms
$R_4$—470 ohms
$C_1$—100 microfarad
$C_2$—1 microfarad
$D_1$—200 milliAmpere, 15 volts
$D_2$—1 ampere, 15 volts The above values will secure a 5 minute idle period for the engine, prior to final shutdown.

Figure 3:
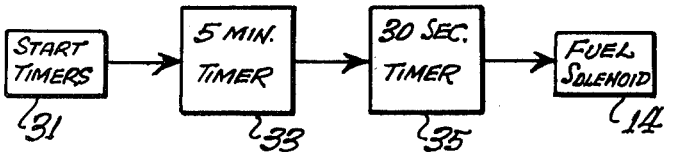

The schematic diagram of FIG. 3 represents an alternate embodiment of the timer control 3, specifically adapted to the shutdown requirements of Detroit Diesel engines, manufactured by General Motors Corporation. These engines commonly employ a fuel valve whose solenoid is only energized to stop fuel flow; the solenoid is de-energized during normal engine operation. The timer circuitry employs a starting device 31, either a manual switch or an automatic sensor operated by the act of removing the ignition key from the ignition switch. The activation of the starting device 31 initiates a timing cycle in a timer 33, commonly set at a condition producing an output signal for a period of five minutes. The timer 33, in turn, transfers control to a secondary timer 35, at the expiration of the primary control period. The secondary timer 35 is set to operate for a relatively brief period, typically 30 seconds, during which it closes the fuel valve by supplying power to the valve solenoid 14. It should be noted that both the timers 33 and 35 are basically as described with reference to FIG. 3, but that the output transistor may be omitted from the timer 33 which is only required to provide a pulse signal at the end of the preset period, to initiate the operation of timer 35.

Figure 4:
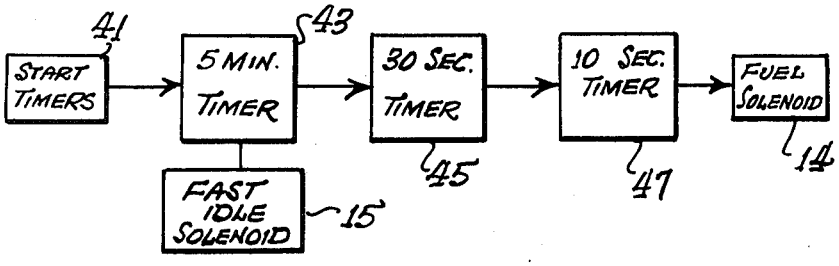

The schematic diagram of FIG. 4 is particularly adapted to perform the requisite stopping procedure for Diesel engines manufactured by Caterpiller Corporation—and others—for which two different speed regimes are advised during the cooling off period prior to engine shutdown.

A starting circuit 41 is employed to initiate the operation of a primary timer 43, the output of which is utilized to power a solenoid operator securing the throttle valve, or an analogous control element, in the 'fast idle' position. Typically this regime may be maintained for a period of five minutes. The primary timer 43 provides the start signal to a secondary timer 45 which maintains engine speed in the slow idle regime for an additional period which may be as short as 30 seconds. The secondary timer 45 initiates the operation of a tertiary timer 47 whose output secures the cessation of fuel flow, by energizing the fuel valve solenoid coil 14.

The foregoing embodiments and variants on the shutdown timer control of the invention are basically illustrative. Variations in the physical layout and in the selection of specific components may suggest themselves to one skilled in the art of internal combustion engine controls, upon exposure to the teachings herein. Such variations and changes are deemed to be encompassed by the invention, which is only delimited by the appended claims.

As an example of the above substitutions, the use of electromechanical heated bimetallic switch element - timers in place of the integrated circuit time-lapse unit if fully in accord with the teachings of the invention, as is the use of relay switches in place of the power transistors as the output control elements of the timing circuit.

The inventor claims:

1. A controller for the automatic performance of predetermined operating modes prior to the shut down of automotive diesel engines equipped with exhaust-turbine superchargers, said controller comprising:

integrated circuit means wired as a time-lapse mechanism, an initiating circuit connected to said integrated circuit means for starting the time-lapse operation thereof, switching means connected to the electrical circuit of the diesel engine; and a momentary switch connected to said initiating circuit, whereby said initiating circuit induces said integrated circuit means to provide an output signal for a predetermined period of time, and whereby said output signal operates said switching means to provide current derived from the electrical circuit of said diesel engine to ensure the operation of the engine at a predetermined speed regime for said predetermined period of time, wherein said integrated circuit means include a plurality of integrated circuit devices, each adapted to provide a particular output signal for a predetermined time, and wherein said switching means include a plurality of switching elements, each operated by one of said output signals, for the provision of a plurality of sequential current to the integral controls of the engine, to ensure the operation of said engine for said plurality of predetermined periods of time, each at a predetermined speed require.

2. The controller of claim 1, wherein said momentary switch is a manually operated switch.

3. The controller of claim 1, wherein said initiating circuit includes automatic sensing means energized by the transfer of said integral engine controls to the shutdown mode.

4. The controller of claim 1, wherein said plurality of integrated curcuit devices include:

a primary timer for the operation of primary switching means;

a secondary timer for the operation of secondary switching means; and a tertiary timer for the operation of tertiary switching means, whereby said primary switching means energize said engine controls into operating the engine in a relatively high speed for a predetermined first period of time, and said secondary switching means energize the engine controls into operating the engine at a relatively low speed for a second predetermined period of time, and said tertiary switching means operates a shut-down valve in the main fuel line of said engine, for a predetermined third period of time, to secure cessation of engine rotation.

* * * * *